US006957928B1

(12) United States Patent
Lofton

(10) Patent No.: US 6,957,928 B1
(45) Date of Patent: Oct. 25, 2005

(54) PORTABLE FLOODWATER BARRIER SYSTEM

(76) Inventor: Malcolm B. Lofton, 12074 New Castle Ave., Apartment 203, Baton Rouge, LA (US) 70816

( * ) Notice: Subject to any disclaimer, the term of this patent is extended or adjusted under 35 U.S.C. 154(b) by 0 days.

(21) Appl. No.: 10/659,623

(22) Filed: Sep. 10, 2003

(51) Int. Cl.[7] ..... E02B 7/00
(52) U.S. Cl. ..... 405/115; 405/114; 405/111
(58) Field of Search ..... 405/115, 114, 405/111, 107, 87, 91

(56) References Cited

U.S. PATENT DOCUMENTS

| | | | | | |
|---|---|---|---|---|---|
| 4,799,821 | A | * | 1/1989 | Brodersen | 405/115 |
| 5,125,767 | A | * | 6/1992 | Dooleage | 405/115 |
| 5,865,564 | A | * | 2/1999 | Miller et al. | 405/115 |
| 6,641,329 | B1 | * | 11/2003 | Clement | 405/115 |
| 2003/0072618 | A1 | * | 4/2003 | Tang et al. | 405/115 |
| 2003/0118407 | A1 | * | 6/2003 | Gertz et al. | 405/115 |

FOREIGN PATENT DOCUMENTS

| | | | | |
|---|---|---|---|---|
| CH | 655338 | * | 4/1986 | 405/115 |
| DE | 3810493 | * | 3/1989 | 405/115 |

* cited by examiner

*Primary Examiner*—Frederick L. Lagman
(74) *Attorney, Agent, or Firm*—William David Kiesel; Roy Kiesel Keegan & DeNicola, A P.L.C.

(57) ABSTRACT

A portable flood water barrier system is disclosed having one or more portable, attachable, flexible modules. Each module comprises an elongated tubular member sealed at either end by rigid, flanged end caps. Each module is provided with one or more openings to permit the introduction of water, sand or similar material into the tubular member interior cavity. Each module is also provided with one or more sealable openings to permit any water, sand or similar material to be removed from the tubular member interior cavity. The material provides weight the module to hold it in position against the force of the moving floodwaters. With the tubular member interior cavity partially filled with the material the portion of the tubular member in contact with the ground substantially conform in shape to the ground contours to minimize any water seepage under the tubular member. Each end cap has a plate with a center section providing shoulders about which a retaining ring can be used to fix the tubular member between the shoulders and the inside surface of the retaining ring. The perimeter section of the end plate forms the flange that is provided with a series of bolt openings to permit end caps from adjacent modules to be bolted together. The outer face of each flange member can be structured to receive a gasket or other sealing member to form a watertight seal between to adjacent attached end caps.

11 Claims, 3 Drawing Sheets

PORTABLE FLOODWATER BARRIER SYSTEM

BACKGROUND OF THE INVENTION

1. Field of the Invention

This invention relates in general to portable fluid barrier systems, and more particularly to portable dams that can be positioned to protect buildings and other objects against damage from floodwaters.

2. Prior Art

Flooding from rivers and other water bodies that have overflowed their normal banks has year after year wrecked havoc on surrounding buildings, cars and other objects, as well as has caused death to livestock and humans in addition to destruction of farm land. Many attempts have been made to develop suitable barriers that could be quickly erected around buildings or along riverbanks to act as dams to prevent damage from flood waters. Although such barriers have been designed and developed, those that have worked have proven too expensive or too cumbersome to assembly and disassemble or too bulky to store when not in use.

OBJECTS AND SUMMARY OF THE INVENTION

Therefore, one object of this invention is to provide an improved portable barrier system that is inexpensive to manufacture, as well as easy to assembly and disassembly.

Another object of this invention is to provide an improved portable floodwater barrier system that can effectively create relative high barrier walls that withstands the force of the water.

Still another object of this invention is to provide an improved portable floodwater barrier system that can be shaped to fit around any building or other object, as well as continue to maintain its function even when positioned on uneven ground.

Other objects and advantages of this invention shall become apparent from the ensuing descriptions of the invention.

Accordingly, a floodwater barrier system is disclosed utilizing new and novel modules. Each module comprises a flexible tubular member whose cross-sectional shape is determined by the contour of the ground where it is laid, as well as the amount of water or small particle material placed in the flexible tubular member. The tubular member is provided with one or more fill openings for the insertion of the water or small particle material, as well as provided with one or more sealable drain openings for removable of the water or small particle material when the tubular member is not being used. The module also comprises two rigid end caps that seal the opposing ends of the tubular member. Each end cap is constructed from a plate having a perimeter section serving as a flange for attaching to an adjacent module end cap by bolts or other known securing devices. Each end cap also is provided with a center section that is sized and shaped to fit within the cavity of the tubular member. The center section forms a shoulder about which a retaining ring will snugly fit when one end of the tubular member is positioned between the retaining ring and the shoulder. This fit is sufficiently snug to secure and hold the end cap to the tubular member during use. The second similarly constructed end cap is affixed to the opposing end of the tubular member. The floodwater barrier system is formed by joining that number of modules necessary to provide the desired barrier against the floodwater. To achieve the desired shape of the barrier the module tubular members may be constructed to assume any desired configuration, such as straight, curved, U-shaped, or V-shaped when filled with water or small particle material.

BRIEF DESCRIPTION OF THE DRAWINGS

The accompanying drawings illustrate a preferred embodiment of this invention. However, it is to be understood that this embodiment is not intended to be exhaustive, nor limiting of the invention. They are but examples of some of the forms in which the invention may be practiced.

PREFERRED EMBODIMENTS OF THE INVENTION

Figure 1:
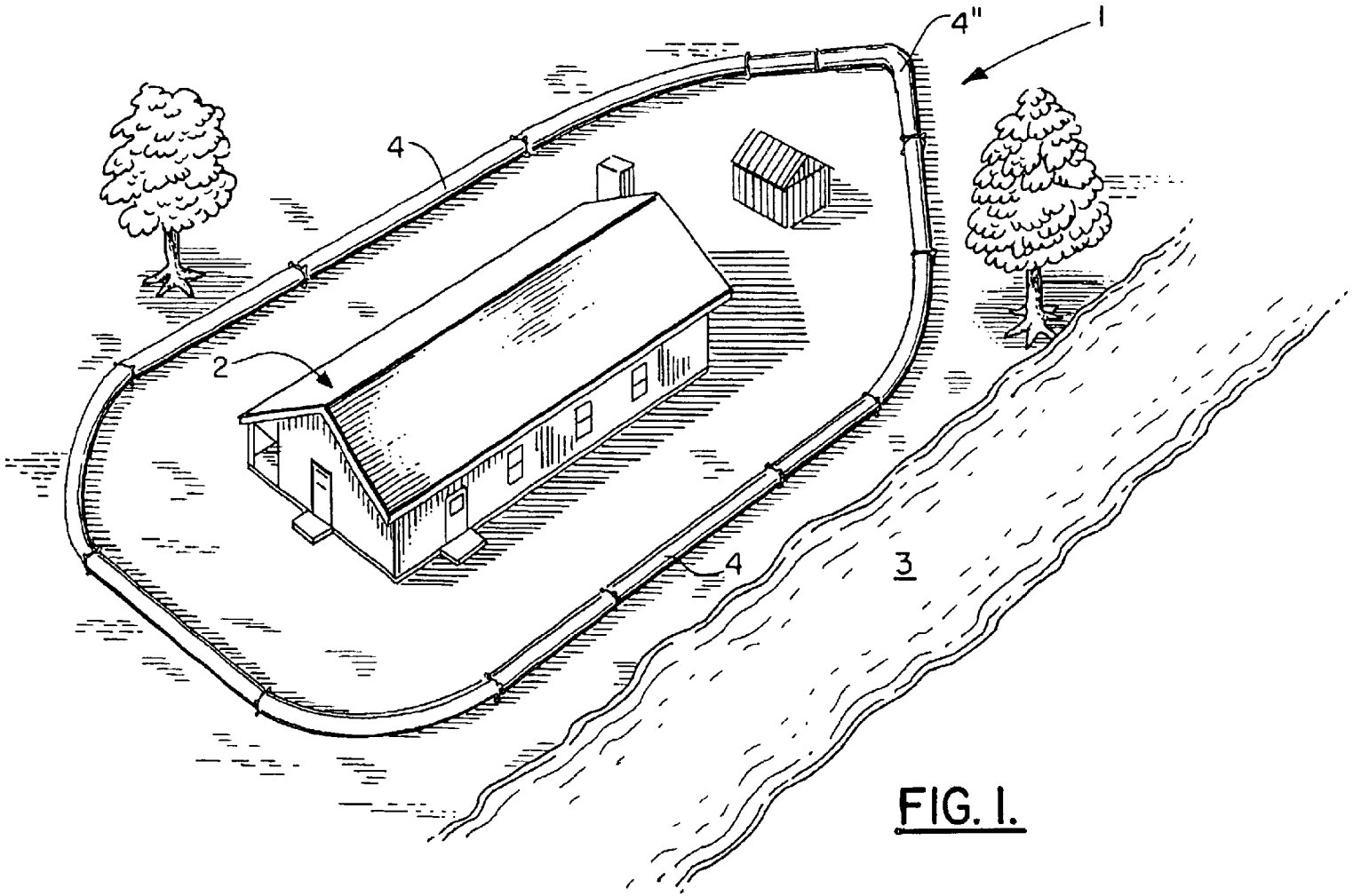
FIG. 1 is a three-quarter perspective view of a preferred embodiment of the portable floodwater barrier system installed around a building to protect the building from damage by rising floodwater from a river.

Without any intent to limit the scope of this invention, reference is made to the figures in describing the preferred embodiments of the invention. Referring to FIG. 1 a floodwater barrier system 1 is illustrated positioned around a building 2 to protect building 2 from rising water when stream 3 floods. The system 1 is formed from a series of attached modules 4 that form a ring around building 2. Modules 4 can be constructed of a wide variety of shapes. This would include elongated straight configurations, L-shaped configuration, U-shaped configurations, V-shaped configurations, or other curved configurations. The configurations selected depend in part on where one desires to establish the floodwater barrier.

Figures 2, 3, 3A:
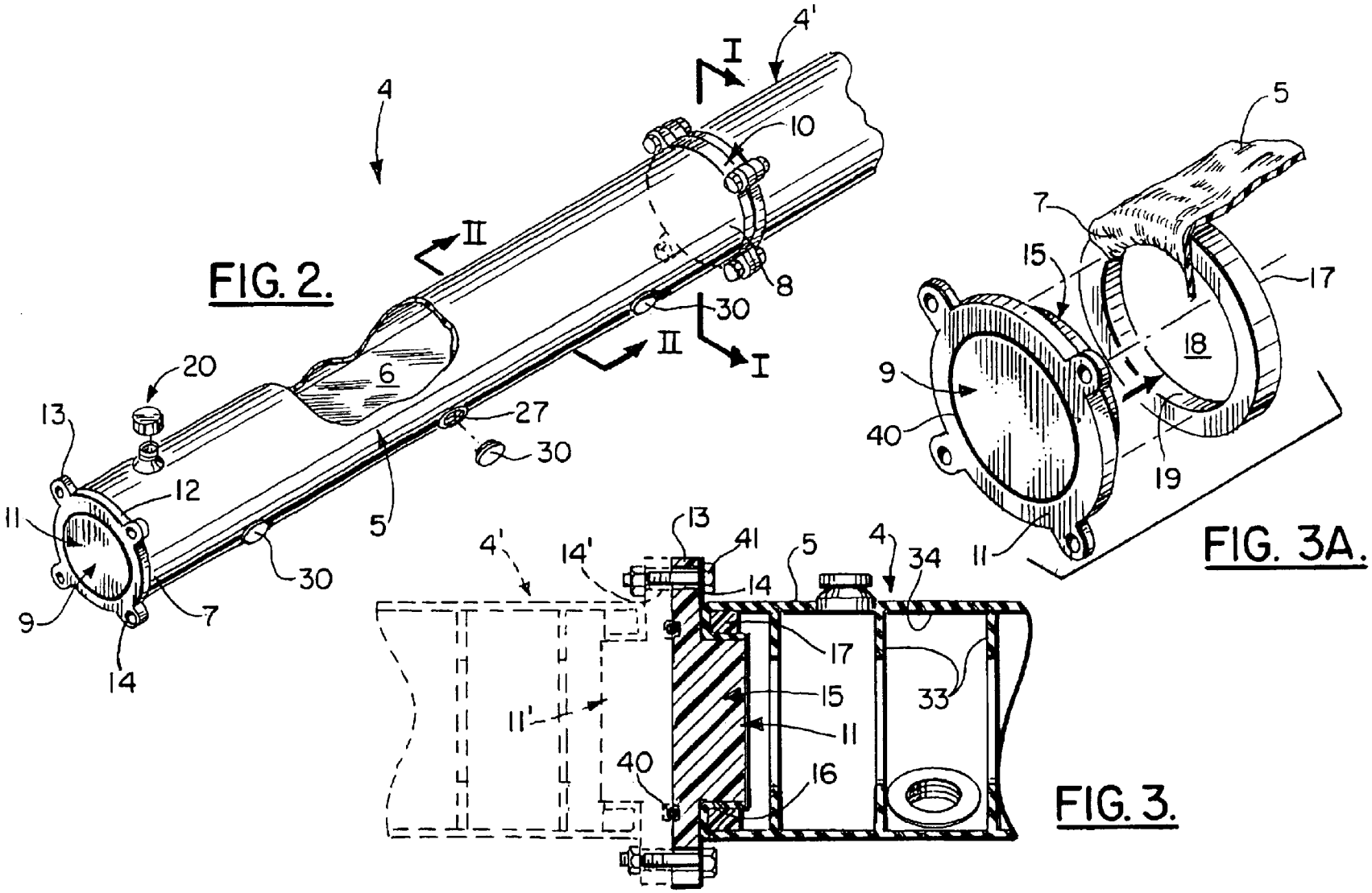
FIG. 2 is a cutaway view of two joined modules of a preferred embodiment of the portable floodwater barrier system.
FIG. 3 is a cross-sectional view taken along lines I—I of FIG. 2.
FIG. 3A is an exploded three-quarter perspective view of the plate and retaining ring of a preferred embodiment of the end cap shown in FIG. 3.
Figure 4:
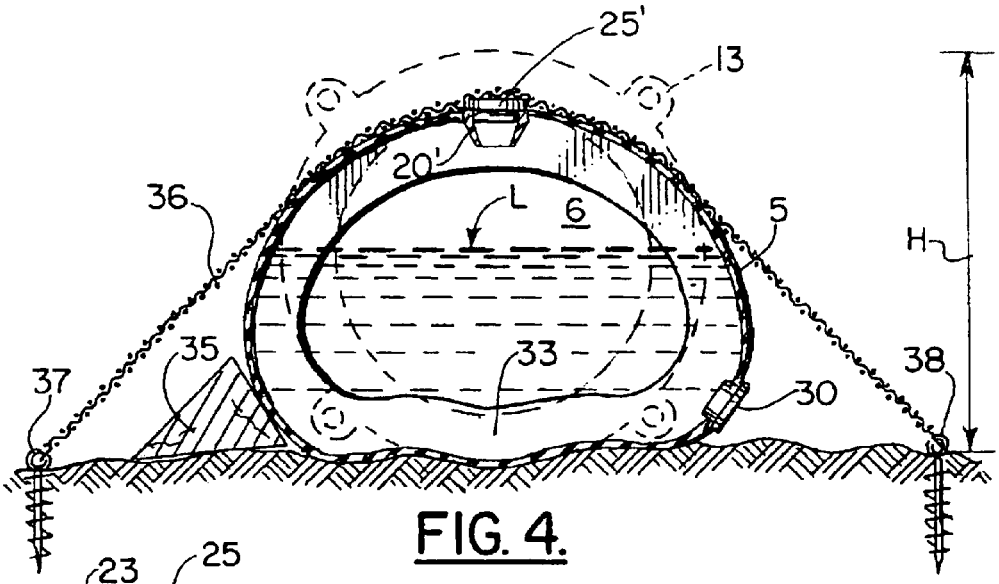
FIG. 4 is a cross-sectional view taken along lines II—II of FIG. 2.

FIGS. 2–4 illustrate a preferred embodiment of module 4 having an elongated, straight configuration. Each module 4 comprises an elongated tubular member 5 forming a cavity 6 between its opposing open ends 7 and 8 that when filled with water or small particle materials, such as sand or pebbles will assume a straight configuration. Tubular member 5 may be constructed in a multitude of different lengths and heights H depending on the barrier to be formed and the anticipated depth of the floodwaters. It is preferred that tubular member 5 be constructed from material of sufficient flexibility to be flatten and folded to minimize storage space when the module is not in use. It is also preferred that tubular member 5 be sufficiently flexible to conform to the shape of the ground on whit it is to be laid with minimum floodwater leakage under tubular member 5. It is also preferred that tubular member 5 be constructed of material that will withstand the water pressure and other floodwater forces placed on tubular member 5 during use. The material should also be selected to minimize the risk from puncture caused by debris moving in the floodwater.

Figure 6:
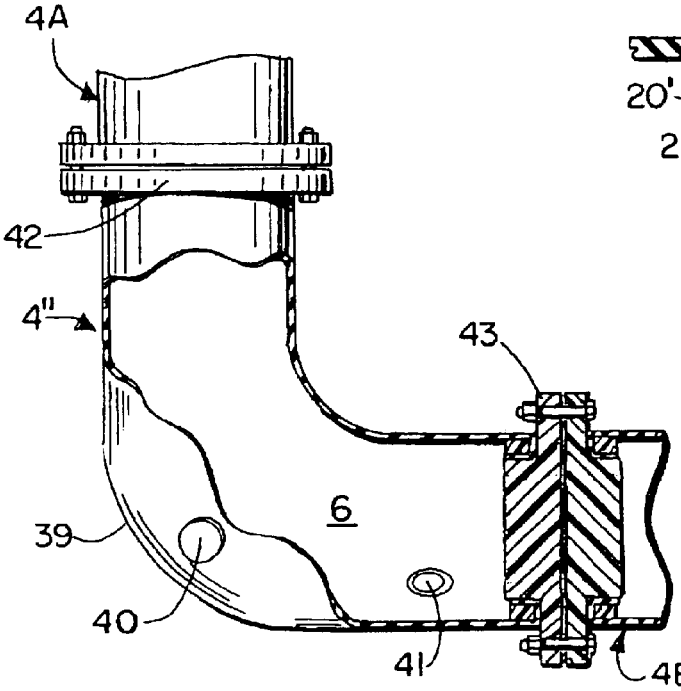
FIG. 6 is a cutaway top view of one preferred embodiment of a water diverting member joined with two segments forming part of the portable barrier system.

Each module 4 also comprises end caps 9 and 10 that used to seal open ends 7 and 8, respectively. Each end cap 9 and 10 is constructed from rigid plate 11 having a perimeter section 12 forming flange 13 having a series of bolt openings 14 positioned to align with bolt openings 14' in another module 4' placed adjacent to module 4. Perimeter section 12 may be circular as shown in FIG. 6. Alternatively, as shown in FIG. 3A, it can include ear sections in those areas necessary to position a sufficient number of bolt openings 14 to provide the necessary water tight seal between adjacent plates 11 and 11' when bolted together. Each end cap 9 and 10 has a center section 15 forming shoulders 16 sized and shaped to extend into cavity 6. Each end cap 9 and 10 also has a retaining ring 17 with a central opening 18 that fits snugly about shoulders 16 when the end section 7 of tubular member 5 is positioned between shoulders 16 and the retainer ring inside surface 19. Preferably end section 7 is wrapped about retaining ring 17 and positioned between shoulders 16 and the inside surface 19 of retaining ring 17.

Figure 5A:
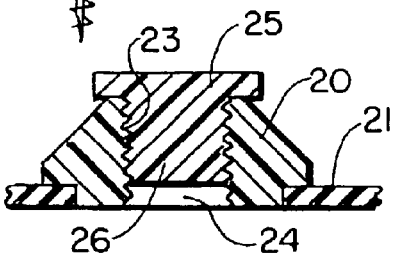
FIG. 5A is a cross-sectional view of one preferred embodiment of the sealable fill opening used in a segment forming part of the portable barrier system.

Each tubular member 5 is provided with a fill member 20 through which water or small particle material, such as sand or pebbles may be introduced into cavity 6 to provide the desired form, height and weight of module 4. Fill member 20 can be constructed to extend out from the top surface 21 as shown in FIG. 5A. In this embodiment it is preferred that fill member have a threaded interior surface 23 forming fill opening 24 that can be sealed by cover 25 having threaded shaft 26 mating with threaded interior wall surface 23 to permit cover 25 to be screwed into sealing position.

Figure 5C:
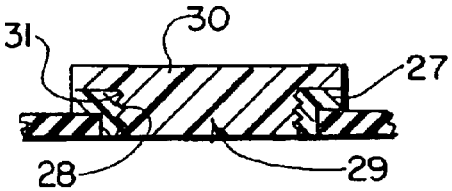
FIG. 5C is a cross-sectional view of one preferred embodiment of the sealable drain opening used in a segment forming part of the portable barrier system.
Figure 5B:
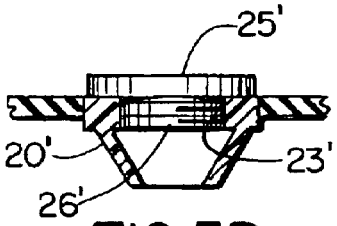
FIG. 5B is a cross-sectional view of an alternate preferred embodiment of the sealable fill opening used in a segment forming part of the portable barrier system.

In an alternate embodiment illustrated in FIG. 5B, fill member 20' can extend into cavity 6. In this embodiment fill member 20' is provided with a threaded interior wall surface 23' that permits cover 25' having threaded shaft 26' to permit cover 25' to be screwed into sealing position.

Each tubular member 5 is also provided with one or more drain members 27. As illustrated in FIG. 5C, drain member 27 has an interior threaded wall surface 28 forming drain opening 29 to permit cap 30 having threaded shaft 31 to be screwed into sealing position.

In a preferred embodiment, each tubular member 5 will be provided with a series of baffles 33 extending from the tubular member inner surface 34 to provide a more controlled fill of tubular member 5. This will better prevent tubular member 5 from moving if itis positioned on an incline. If tubular member 5 is positioned on an incline it is preferred to position chocks 35 on the downside of tubular member 5 to prevent it from rolling. Alternatively, a netting 36 positioned over tubular member 5 that is anchored on opposite sides of tubular member 5 by augers 37 and 38.

In an alternate embodiment, such as illustrated in FIG. 6, module 4" has a tubular member 39 forming a curved shape. In this embodiment, module 4" is provided with a fill opening 40 and a drain opening 41 that can be similarly sealed by caps 25" and 30". Module 4" will also be provided with end caps 42 and 43 that can be used to attached adjacent modules 4A and 4B, respectively.

In operation, multiple modules 4 are placed in the desired position and bolted together. The modules are partially filled. If a module is placed on an incline, then either chocks 35 or net 36 is put in place to prevent that module from pulling the other modules down the incline. The modules are then filled to the desired level L to achieve the height H.

There are of course other alternate embodiments that are obvious from the foregoing descriptions of the invention which are intended to be included within the scope of the invention as defined by the following claims.

What I claim is:

1. A module for use in forming a floodwater barrier system, the module having an elongated flexible tubular member, the tubular member having a cavity open at its opposite ends, the tubular member having at least one fill opening, the improvement to which comprises:

(a) a first rigid end cap attachable to one of the open ends of the tubular member in a manner to seal the one open end, and (b) a second rigid end cap attachable to the other end of the tubular member in a manner to seal the other end, each of the first and second rigid end caps comprising:

(i) an end plate having a perimeter section formed at least in part by a flange section, the end plate having a center section having a shoulder member extending outward from the center section, the shoulder being shaped and sized to fit within the cavity of the tubular member, and (ii) a retaining member having a center opening that is shaped and sized fit about the shoulder to securely retain the tubular member to the flanged end plate when the one of the ends of the tubular member is positioned between the shoulder and the retaining member.

2. A module according to claim 1 wherein the flange section forms the perimeter of the end cap.

3. A module for use in the construction of a floodwater barrier system comprising:

(a) a flexible tubular member open at opposing ends and forming a cavity and having at least one fill opening for the insertion of a fluid or small particle material;

(b) two rigid end caps for sealing each of the opposing ends, each end cap having a perimeter section forming a flange for use in attaching an adjacent module, and having a center section forming a shoulder sized and shaped to fit within the cavity; and (c) two retaining rings, each retaining ring shaped and sized to fit about one of the shoulders to retain one of the opposing ends positioned between corresponding shoulder and retaining ring.

4. A module according to claim 1 wherein the flexible tubular member further having a sealable drain opening for removing the fluid or small particle material.

5. A module according to claim 1 wherein the tubular member is constructed at least in part from nylon, rubber, cotton, or fabric blend having nylon, rubber, cotton forming at least a portion of the fabric blend.

6. A module according to claim 1 wherein the flange having a series of bolt openings.

7. A module according to claim 1 wherein the tubular member forms an elongated, substantially straight shape when filled with the fluid or small particle material.

8. A module according to claim 1 wherein the tubular member having at least a segment forming a curved shape when filled with the fluid or small particle material.

9. A module according to claim 8 wherein the curved shape is V-shaped or U-shaped.

10. A floodwater barrier system comprising two or more modules, each module comprising:

(a) an elongated, flexible tubular member forming a cavity open at opposite ends and having at least one fill opening, (b) a first rigid end cap attachable to one of the open ends of the tubular member in a manner to seal the one open end, and (c) a second rigid end cap attachable to the other end of the tubular member in a manner to seal the other end, each of the first and second rigid end caps comprising:

(i) an end plate having a perimeter section formed at least in part by a flange section provided with a series of bolt openings alignable with corresponding bolt openings in an adjacent end plate of an adjacent tubular member, and having a center section having a shoulder member extending outward from the center section, the shoulder being shaped and sized to fit within the cavity of the tubular member, and (ii) a retaining member having a center opening that is shaped and sized to fit about the shoulder to securely retain the tubular member to the flanged end plate when the one of the ends of the tubular member is positioned between the shoulder and the retaining member.

11. A floodwater barrier system according to claim 10 further comprising a corner module comprising a corner tubular member forming a cavity with open ends, the corner tubular member formed at least in part by two flexible end sections flanking a center arcuate-shaped center section, a first rigid end cap attachable to one of the open ends of the corner tubular member in a manner to seal the one open end, and a second rigid end cap attachable to the other end of the corner tubular member in a manner to seal the other end, each of the first and second rigid end caps comprising:

(a) a corner end plate having a perimeter section formed at least in part by a flange section provided with a series of bolt openings alignable with corresponding bolt openings in an adjacent end plate of an adjacent tubular member, and having a center section having a shoulder member extending outward from the center section, the shoulder being shaped and sized to fit within the cavity of the corner tubular member, and (b) a retaining member having a center opening that is shaped and sized to fit about the shoulder to securely retain the corner tubular member to the flanged end plate when the one of the ends of the corner tubular member is positioned between the shoulder and the retaining member.

* * * * *